US011434779B2

(12) United States Patent
Shaw

(10) Patent No.: US 11,434,779 B2
(45) Date of Patent: Sep. 6, 2022

(54) VANE AND SHROUD ARRANGEMENTS FOR A TURBO-MACHINE

(71) Applicant: Cummins Ltd., London (GB)

(72) Inventor: Christopher J. Shaw, Huddersfield (GB)

(73) Assignee: CUMMINS LTD., London (GB)

( * ) Notice: Subject to any disclaimer, the term of this patent is extended or adjusted under 35 U.S.C. 154(b) by 0 days.

(21) Appl. No.: 17/055,316

(22) PCT Filed: May 14, 2019

(86) PCT No.: PCT/GB2019/051316
§ 371 (c)(1),
(2) Date: Nov. 13, 2020

(87) PCT Pub. No.: WO2019/220096
PCT Pub. Date: Nov. 21, 2019

(65) Prior Publication Data

US 2021/0222582 A1 Jul. 22, 2021

(30) Foreign Application Priority Data

May 15, 2018 (GB) ..... 1807883

(51) Int. Cl.
*F01D 17/14* (2006.01)
*F01D 17/16* (2006.01)

(52) U.S. Cl.
CPC ..... *F01D 17/16* (2013.01); *F01D 17/167* (2013.01); *F01D 17/143* (2013.01); *F05D 2220/40* (2013.01); *F05D 2240/128* (2013.01)

(58) Field of Classification Search
CPC ..... F01D 17/167; F01D 17/143; F01D 17/16; F01D 17/141; F01D 17/14
See application file for complete search history.

(56) References Cited

U.S. PATENT DOCUMENTS 5,452,986 A * 9/1995 Osborne ..... F04D 29/462 415/150
7,097,432 B1 * 8/2006 Lombard ..... F01D 17/167 417/295

(Continued)

FOREIGN PATENT DOCUMENTS

CN 101915129 A 12/2010
DE 102013002192 A1 8/2014

(Continued)

OTHER PUBLICATIONS

International Search Report and Written Opinion, issued by the European Patent Office dated Aug. 2, 2019, for International Application No. PCT/GB2019/051316; 10 pages.

(Continued)

*Primary Examiner* — Richard A Edgar
*Assistant Examiner* — Behnoush Haghighian
(74) *Attorney, Agent, or Firm* — Faegre, Drinker, Biddle & Reath, LLP

(57) ABSTRACT

A turbine for a turbo-machine is proposed in which, at a gas inlet for a turbine wheel, vanes extend from a nozzle ring though slots in a shroud. The vanes are formed with a leading portion which is arranged to contact a leading portion of a corresponding slot, and a trailing portion which is shaped, when the leading portion of the vane and slot are together, to be spaced from a corresponding trailing portion of the slot with a substantially constant spacing at room temperature. The contact may be a point contact, e.g. close to the leading edge of the vane. Alternatively, the vane may include a leading surface portion which conforms closely with the shape of a corresponding leading surface portion of one of the slots.

9 Claims, 8 Drawing Sheets

(56) References Cited

U.S. PATENT DOCUMENTS

| | | | | |
|---|---|---|---|---|
| 8,172,516 | B2 * | 5/2012 | Parker | F01D 17/143 415/151 |
| 8,647,056 | B2 * | 2/2014 | Holroyd | F01D 17/143 415/164 |
| 8,764,388 | B2 * | 7/2014 | Roberts | F02B 37/24 415/158 |
| 9,488,065 | B2 * | 11/2016 | Olmstead | F01D 17/143 |
| 2013/0177403 | A1 * | 7/2013 | Olmstead | F01D 17/16 415/159 |
| 2015/0345376 | A1 * | 12/2015 | Ibaraki | F02B 39/005 60/605.1 |

FOREIGN PATENT DOCUMENTS

| | | | |
|---|---|---|---|
| GB | 2458191 | A | 9/2009 |
| GB | 2462115 | A | 1/2010 |
| GB | 2497786 | A | 6/2013 |
| GB | 2555872 | A | 5/2018 |

OTHER PUBLICATIONS

International Preliminary Report on Patentability issued by The International Bureau of WIPO, dated Nov. 11, 2020, for International Application No. PCT/GB2019/051316; 6 pages.

* cited by examiner

PRIOR ART

VANE AND SHROUD ARRANGEMENTS FOR A TURBO-MACHINE

CROSS-REFERENCE TO RELATED APPLICATIONS

The present application claims priority to PCT Application No. PCT/GB2019/051316, filed May 14, 2019, which claims priority to United Kingdom Patent Application No. 1807883.2, filed on May 15, 2018, the disclosure of which being expressly incorporated herein by reference.

FIELD OF THE DISCLOSURE

The present disclosure relates to vane and shroud arrangement for positioning at a gas inlet of a turbo-machine such as a turbo-charger.

BACKGROUND OF THE DISCLOSURE

Turbochargers are well-known devices for supplying air to the intake of an internal combustion engine at pressures above atmospheric pressure (boost pressures). A conventional turbocharger essentially comprises an exhaust gas driven turbine wheel mounted on a rotatable shaft within a turbine housing. Rotation of the turbine wheel rotates a compressor wheel mounted on the other end of the shaft within a compressor housing. The compressor wheel delivers compressed air to the inlet manifold of the engine, thereby increasing engine power. The turbocharger shaft is conventionally supported by journal and thrust bearings, including appropriate lubricating systems, located within a central bearing housing connected between the turbine and compressor wheel housing.

In known turbochargers, the turbine stage comprises a turbine chamber within which the turbine wheel is mounted; an annular inlet passageway defined between facing radial walls arranged around the turbine chamber; an inlet arranged around the inlet passageway; and an outlet passageway extending axially from the turbine chamber. The passageways and chambers communicate such that pressurised exhaust gas admitted to the inlet chamber flows through the inlet passageway to the outlet passageway via the turbine and rotates the turbine wheel.

It is known to improve turbine performance by providing vanes, referred to as nozzle vanes, in the inlet passageway so as to deflect gas flowing through the inlet passageway towards the direction of rotation of the turbine wheel. Each vane is generally laminar, and is positioned with one radially outer surface arranged to oppose the motion of the exhaust gas within the inlet passageway, i.e. the radially inward component of the motion of the exhaust gas in the inlet passageway is such as to direct the exhaust gas against the outer surface of the vane, and it is then redirected into a circumferential motion.

Turbines may be of a fixed or variable geometry type. Variable geometry type turbines differ from fixed geometry turbines in that the geometry of the inlet passageway can be varied to optimise gas flow velocities over a range of mass flow rates so that the power output of the turbine can be varied to suit varying engine demands.

In one form of a variable geometry turbocharger, a nozzle ring carries a plurality of axially extending vanes, which extend into the air inlet, and through respective apertures ("slots") in a shroud which forms a radially-extending wall of the air inlet. The nozzle ring is axially movable by an actuator to control the width of the air passage. Movement of the nozzle ring also controls the degree to which the vanes project through the respective slots.

An example of such a variable geometry turbocharger is shown in FIGS. 1(*a*) and 1(*b*), taken from U.S. Pat. No. 8,172,516. The illustrated variable geometry turbine comprises a turbine housing 1 defining an inlet chamber 2 to which gas from an internal combustion engine (not shown) is delivered. The exhaust gas flows from the inlet chamber 2 to an outlet passageway 3 via an annular inlet passageway 4. The inlet passageway 4 is defined on one side by the face of a movable annular wall member 5 which constitutes the nozzle ring, and on the opposite side by an annular shroud 6, which covers the opening of an annular recess 8 in the facing wall.

Gas flowing from the inlet chamber 2 to the outlet passageway 3 passes over a turbine wheel 9 and as a result torque is applied to a turbocharger shaft 10 supported by a bearing assembly 14 that drives a compressor wheel 11. Rotation of the compressor wheel 11 about rotational axis 100 pressurizes ambient air present in an air inlet 12 and delivers the pressurized air to an air outlet 13 from which it is fed to an internal combustion engine (not shown). The speed of the turbine wheel 9 is dependent upon the velocity of the gas passing through the annular inlet passageway 4. For a fixed rate of mass of gas flowing into the inlet passageway, the gas velocity is a function of the width of the inlet passageway 4, the width being adjustable by controlling the axial position of the nozzle ring 5. As the width of the inlet passageway 4 is reduced, the velocity of the gas passing through it increases. FIG. 1(*a*) shows the annular inlet passageway 4 closed down to a minimum width, whereas in FIG. 1(*b*) the inlet passageway 4 is shown fully open.

The nozzle ring 5 supports an array of circumferentially and equally spaced vanes 7, each of which extends across the inlet passageway 4. The vanes 7 are orientated to deflect gas flowing through the inlet passageway 4 towards the direction of rotation of the turbine wheel 9. When the nozzle ring 5 is proximate to the annular shroud 6 and to the facing wall, the vanes 7 project through suitably configured slots in the shroud 6 and into the recess 8. Each vane has an "inner" major surface which is closer to the rotational axis 100, and an "outer" major surface which is further away. Both the nozzle ring 5 and the shroud 6 are at a fixed angular position about the axis 100. The vanes 7 are illustrated in FIGS. 1(*a*) and 1(*b*) as having a chamfered end portion (towards the right of the figures), but in most modern arrangements the vanes are either longitudinally symmetric along their whole length, or else composed of two sections which are each longitudinally symmetric but which have a different profile from each other as viewed in the axial direction.

A pneumatically or hydraulically operated actuator 16 is operable to control the axial position of the nozzle ring 5 within an annular cavity 19 defined by a portion 26 of the turbine housing via an actuator output shaft (not shown), which is linked to a stirrup member (not shown). The stirrup member in turn engages axially extending guide rods (not shown) that support the nozzle ring 5. Accordingly, by appropriate control of the actuator 16 the axial position of the guide rods and thus of the nozzle ring 5 can be controlled. It will be appreciated that electrically operated actuators could be used in place of a pneumatically or hydraulically operated actuator 16.

The nozzle ring 5 has axially extending inner and outer annular flanges 17 and 18 respectively that extend into the annular cavity 19, which is separated by a wall 27 from a chamber 15. Inner and outer sealing rings 20 and 21, respectively, are provided to seal the nozzle ring 5 with respect to inner and outer annular surfaces of the annular cavity 19, while allowing the nozzle ring 5 to slide within the annular cavity 19. The inner sealing ring 20 is supported within an annular groove 22 formed in the inner surface of the cavity 19 and bears against the inner annular flange 17 of the nozzle ring 5, whereas the outer sealing ring 21 is supported within an annular groove 23 provided within the annular flange 18 of the nozzle ring 5 and bears against the radially outermost internal surface of the cavity 19. It will be appreciated that the inner sealing ring 20 could be mounted in an annular groove in the flange 17 rather than as shown, and/or that the outer sealing ring 21 could be mounted within an annular groove provided within the outer surface of the cavity rather than as shown. A first set of pressure balance apertures 25 is provided in the nozzle ring 5 within the vane passage defined between adjacent apertures, while a second set of pressure balance apertures 24 are provided in the nozzle ring 5 outside the radius of the nozzle vane passage.

Note that in other known turbomachines, the nozzle ring is axially fixed and an actuator is instead provided for translating the shroud in a direction parallel to the rotational axis. This is known as a "moving shroud" arrangement.

In known variable geometry turbo-machines which employ vanes projecting through slots in a shroud, a clearance is provided between the vanes and the edges of the slots to permit thermal expansion of the vanes as the turbocharger becomes hotter. As viewed in the axial direction, the vanes and the slots have the same shape, but the vanes are smaller than the slots. In a typical arrangement, the vanes are positioned with an axial centre line of each vane in a centre of the corresponding slot, such that in all directions away from the centre line transverse to the axis of the turbine, the distance from the centre line to the surface of the vane is the same proportion of the distance from the centre line to the edge of the corresponding slot. The clearance between the vanes and the slots is generally arranged to be at least about 0.5% of the distance of a centre of the vanes from the rotational axis (the "nozzle radius") at room temperature (which is here defined as 20 degrees Celsius) around the entire periphery of the vane (for example, for a nozzle radius of 46.5 mm the clearance may be 0.23 mm, or 0.5% of the nozzle radius). This means that, if each of the vanes gradually thermally expands perpendicular to the axial direction, all points around the periphery of the vane would touch a corresponding point on the slot at the same moment. At all lower temperatures, there is a clearance between the entire periphery of the vane and the edge of the corresponding slot.

SUMMARY OF THE DISCLOSURE

The present disclosure aims to provide new and useful vane and shroud assemblies for use in a turbo-machine, as well as new and useful turbo-machines (especially turbochargers) incorporating the vane assemblies.

In an earlier patent application (GB 1619347.6, which was unpublished at the priority date of the present application), the present applicant proposed that in the turbine of a turbomachine of the kind in which, at a gas inlet between a nozzle ring and a shroud, vanes project from the nozzle through slots in the shroud, one "conformal" portion of a lateral (i.e. transverse to the rotational axis) surface of each vane substantially conforms to the shape of a corresponding "conformal" portion of a lateral surface of the corresponding slot, so as to enable the respective conformal portions of the surfaces to be placed relative to each other with only a small clearance between them. An advantage of this is that gas flow between the respective conformal portions of the surfaces of the vane and the slot can be substantially reduced. This reduces leakage of gas into or out of a recess on the other side of the shroud from the nozzle ring. Such leakage reduces the circumferential redirection of the gas caused by the vanes, and has been found to cause significant losses in efficiency.

Although this proposal represents a significant technical improvement to turbine technology, the present inventors have discovered that in practice its advantages may not be entirely realised. Firstly, the formation of the vanes and slots is subject to tolerances, so that exact conformity between the vane and slot may not be possible. Secondly, after the turbocharger has been in use for some time, the vanes are subject to foreign object damage (FOD) due to debris in the exhaust gas, which reduces the quality of the conformity between the shapes of the vanes and the slots.

In general terms, the present disclosure proposes that the vanes and slots are formed and arranged such that there is contact between them at a leading surface portion of the vane. Away from the leading surface portion, towards the trailing edge of the vane, the vane and slot include respective trailing portions which are spaced apart, such as by a substantially constant amount, and arranged to conform in shape with each other.

The disclosure is motivated by an observation by the inventors that the FOD damage is typically not present in a leading portion of the radially inner surface of the vane, so it should be possible to realise high quality contact in that area between the vane and the edge of the slot. However, if the trailing portion of the vane is designed to be very close to the edge of the slot, then a small amount of FOD damage there, or imperfections in that portion of the vane or slot, can lead to the leading portion of the vane being disadvantageously spaced from the slot edge. By forming the trailing portion of the vane spaced from the slot edge, this effect can be mitigated.

Forming the trailing portion of the slot and vane surfaces can be regarded as analogous to a relief cut using in mechanical cutting of objects, which reduces the risk of the cutting being impeded due to portions of the object distant from where the cutting is occurring.

Furthermore, arranging for the vane and slot to be spaced apart in their respective trailing portions, can reduce the chance of the vane becoming trapped against the slot due to a thermal transient. This is because differential thermal expansion of the trailing portions of the nozzle and slot is less likely to cause them to impact each other, even if it causes the gap between them to decrease.

A specific expression of the disclosure is a turbine comprising:

(i) a turbine wheel having an axis, (ii) a turbine housing for defining a chamber for receiving the turbine wheel for rotation of the turbine wheel about an axis, the turbine housing further defining a gas inlet, and an annular inlet passage from the gas inlet to the chamber, (iii) a ring-shaped shroud defining a plurality of slots and encircling the axis, each slot having a slot surface; and (iv) a nozzle ring supporting a plurality of vanes which extend from the nozzle ring parallel to the axis, and project through respective ones of the slots;

each of the vanes having:

an axially-extending vane surface which includes (i) a vane outer surface facing a radially-outer surface of the corresponding slot, (ii) an opposed vane inner surface facing a radially-inner surface of the corresponding slot, and a median line between the vane inner surface and the vane outer surface extending from a leading end of the vane to a trailing end of the vane;

the vane being positionable with a leading surface portion of the vane inner surface contacting a corresponding leading surface portion of the respective slot surface;

the vane inner surface further including a trailing surface portion extending along at least 33% of the median line and, which, at room temperature and when the leading surface portions are in contact, is spaced from an opposed trailing surface portion of the slot surface by a distance in the range 10 microns to 250 microns, and more preferably at least 25 microns and/or no more than 100 microns.

This spacing provides an effective trade-off between a low spacing, which would reduce gas leaking between the trailing portions, and a high spacing, which would reduce the tendency of imperfections in the trailing portions of the inner vane inner and slot surface to cause those surfaces to meet.

Preferably, at room temperature, the respective profiles of the trailing surface portion of the vane surface and the trailing surface portion of the slot surface diverge from each other by no more than 30 microns, 20 microns or even 10 microns (for a 48.1 mm nozzle radius these correspond to 0.05%, 0.04%, or even 0.02% of the nozzle radius).

The conformity of the trailing surface portions of the vane surface and slot surface may mean that each point on the trailing surface portion of the vane is spaced from a corresponding respective point on the slot inner surface by a distance which is in the range 0.1%-0.3% of the nozzle radius. For a 48.1 mm nozzle radius, this would be a distance range of about 0.05 mm to 0.15 mm.

In a first case, the leading surface portion of the vane may be short (e.g. no more than 5% of the length of the median line), or even a point contact. This may have the advantage of minimising the risk of the vane becoming trapped against the slot due to a thermal transient, since the size of the region in which they approach each other is small.

In a second case, the leading surface portion of the vane may be longer (e.g. extending along at least 15% of the length of the median line). The length of the leading surface portion may for example differ by less than 10% from 100% minus the percentage of the median line along which the trailing surface portion of the vane inner surface extends. The leading surface portion of the vane may be arranged to conform closely with the shape of the leading surface portion of the corresponding slot. They may designed to have exactly the same shape. In practice, however, due to machining tolerances, the respective profiles of the leading surface portion of the vane surface and the corresponding leading surface portion of the respective slot surface may diverge from each other by an amount in the range 1 micron to 50 microns, or more preferably 1 micron to 25 microns. The divergence is preferably less than the minimum spacing of the trailing portions of the vane inner surface and slot surface.

The leading surface portion of the vane surface may extend along 15-20% of the length of the median line, or 15-25% of the length of the median line.

The leading surface portion of the vane may include a point where the median line intercepts the leading edge of the vane. Indeed, when the leading surface portions of the vane surface and slot surface are in contact, the vane surface and slot surface may further contact each other at at least one point which is on the radially-outer surface of the vane.

The trailing portion of the vane surface may extend for at least 50%, at least 60% or at least 70% of the length of the median line.

In this document, the statement that the trailing surface portions of the vane inner surface and slot surface are spaced apart by a certain distance range means that the respective distance from each point in the trailing surface portion to the respective closest point of the trailing surface portion of the slot surface, is in that range. The statement refers to the portion of the vane inner surface which is in axial register with the slot surface.

In this document the statement that two lines diverge from each other by no more than a certain distance x may be understood to mean that the lines can be placed such that the lines do not cross and such that no point along either one of the lines is further than a distance x from the other of the lines. The statement that the leading surface portion of the vane surface and the corresponding leading surface portion of the slot surface diverge from each other by no more than a certain distance x refers to the parts of the leading surface portion of the vane surface and the leading surface portion of the slot surface which are in axial register with each other, and which appear as respective lines when viewed in the axial direction. In such a view, these lines diverge from each other by no more than the distance x.

Preferably the turbine is of the sort in which the radially inner surfaces of the vane and slot are at a lower pressure than the radially outer ones.

The turbine may include a rotational mechanism for generating a rotational torque for urging the nozzle ring to rotate with respect to the shroud, in a sense which urges the respective leading surface portions of the vanes and slots together. In some arrangements, this rotational mechanism is simply the force exerted by the exhaust gas on the vanes.

BRIEF DESCRIPTION OF THE FIGURES

Embodiments of the disclosure will now be described for the sake of example only, with reference to the following drawings in which.

DETAILED DESCRIPTION OF THE EMBODIMENTS

Figure 1A:
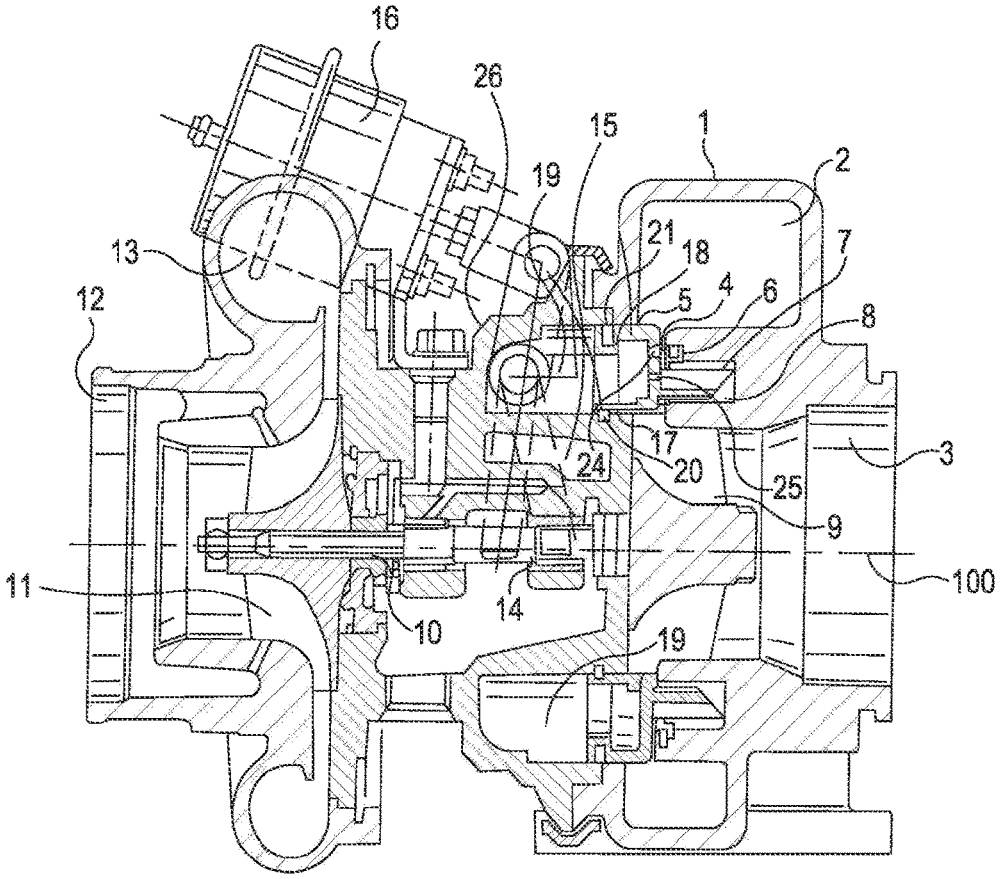
Fig. 1(a) PRIOR ART
FIG. 1 is composed of FIG. 1(*a*) which is an axial cross-section of a known variable geometry turbine, and FIG. 1(*b*) which is a cross-section of a part of the turbine of FIG. 1(*a*)
Figure 1B:
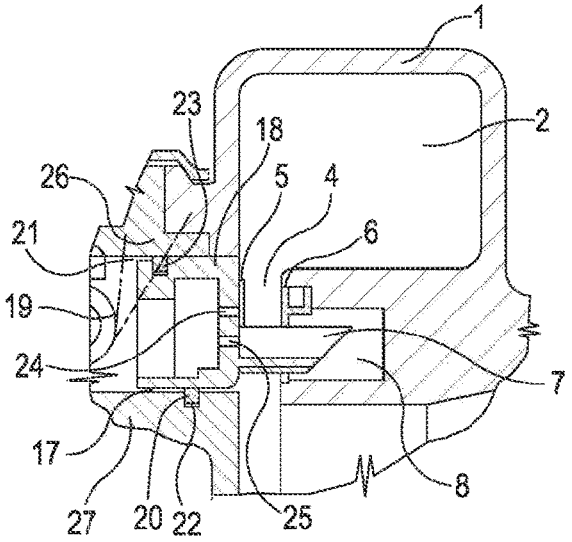
Figure 2:
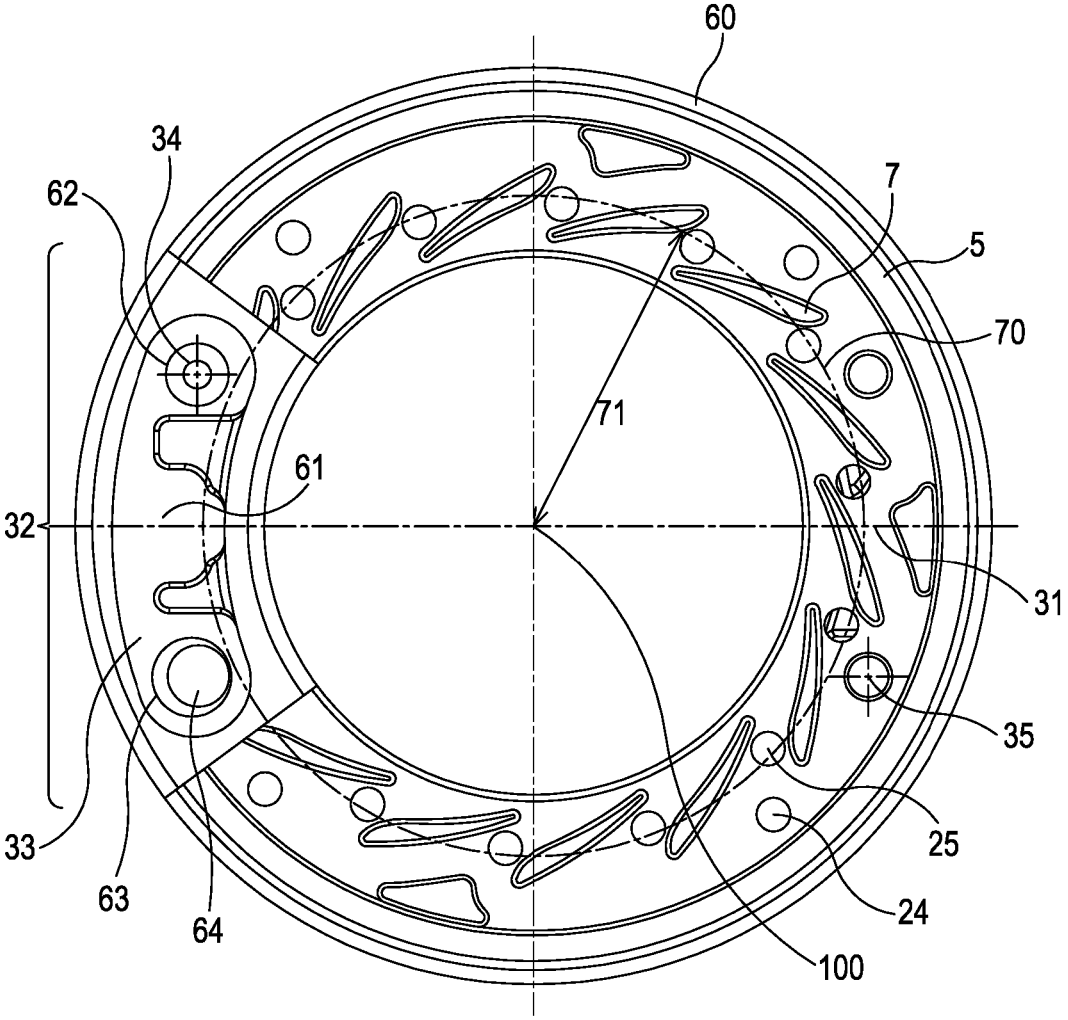
FIG. 2 is an axial view of a nozzle ring which can be used in the known arrangement of FIG. 1.

Referring to FIG. 2, a nozzle ring is shown which could be used in the known turbocharger of FIG. 1. The nozzle ring is viewed in an axial direction from the right as viewed in FIG. 1(*a*) (this direction is also referred to here as "from the turbine end" of the turbocharger), from a position between the nozzle ring 5 and the shroud 6.

The axis of the shaft about which the turbine wheel 9 (not shown in FIG. 2, but visible in FIG. 1(*a*)) and compressor wheel 11 (also not shown in FIG. 2, but visible in FIG. 1(*a*)) rotate is denoted as 100.

Viewed in this axial direction, the substantially-planar annular nozzle ring 5 encircles the axis 100. From the nozzle ring 5, vanes 7 project in the axial direction. Defining a circle 70 centred on the axis 100 and passing through the centroids of the profiles of the vanes 7, we can define the nozzle radius 71 as the radius of the circle 70. Gas moves radially inwardly in the gap between the nozzle ring 5 and the shroud 6.

The nozzle ring 5 is moved axially by an actuator 16 (not shown in FIG. 2, but visible in FIG. 1(*a*)) within an annular cavity (also not shown in FIG. 2, but visible in FIG. 1(*a*)) defined by a portion 60 of the turbine housing. Each vane 7 is optionally longitudinally-symmetric (that is, its profile as viewed in the axial direction, may be same in all axial positions), although in some embodiments only a portion of the vane 7 is longitudinally-symmetric. The profile of the vane (or the longitudinally-symmetric part of it) looking along the longitudinal axis is elongate, having two ends, with a median line extending between those ends. To either side of the median line is major surface of the vane where the profile has relatively low curvature, and at either end of the median line the curvature of the profile is higher.

The actuator exerts a force on the nozzle ring 5 via two axially-extending guide rods. In FIG. 2, a portion 32 of the nozzle ring 5 is omitted, making it possible to view the connection between the nozzle ring 5 and a first of the guide rods. The guide rod is not shown, but its centre is in a position labelled 61. The guide rod is integrally formed with a bracket 33 (commonly called a "foot") which extends circumferentially from the guide rod to either side. The bracket 33 contains two circular apertures 62, 63. The surface of the nozzle ring 5 which faces away from the shroud 6 is formed with two bosses 34, 64 which project from the nozzle ring 6. Each of the bosses 34, 64 has a circular profile (viewed in the axial direction). The bosses 34, 64 are inserted respectively in the apertures 62, 63, and the bosses 34, 64 are sized such that the boss 34 substantially fills the aperture 62, while the boss 64 is narrower than the aperture 63. The connection between the boss 34 and the aperture 62 fixes the circumferential position of the nozzle ring 5 with respect to the bracket 33 (in typical realizations, the relative circumferential motion of the nozzle ring 5 and the shroud 6 about the axis 100 is no more than 0.05 degrees). However, the clearance between the boss 64 and the aperture 63 permits the bracket 33 to rotate slightly about the boss 34 if the guide rods move apart radially due to thermal expansion. For that reason, the boss 34 is referred to as a "pivot".

The location, as viewed in the axial direction, at which a second of the guide rods is connected to the nozzle ring 5 is shown as 31. The connection between the nozzle ring 5 and the second guide rod is due to a second bracket (not visible in FIG. 2) integrally attached to the second guide rod. The second bracket is attached to the rear surface of the nozzle ring 5 in the same way as the bracket 33. The pivot for the second bracket is at the location 35.

Holes 24, 25 are balance holes provided in the nozzle ring 5 for pressure equalisation. They are provided to achieve a desirable axial load (or force) on the nozzle ring 5.

Figure 3:
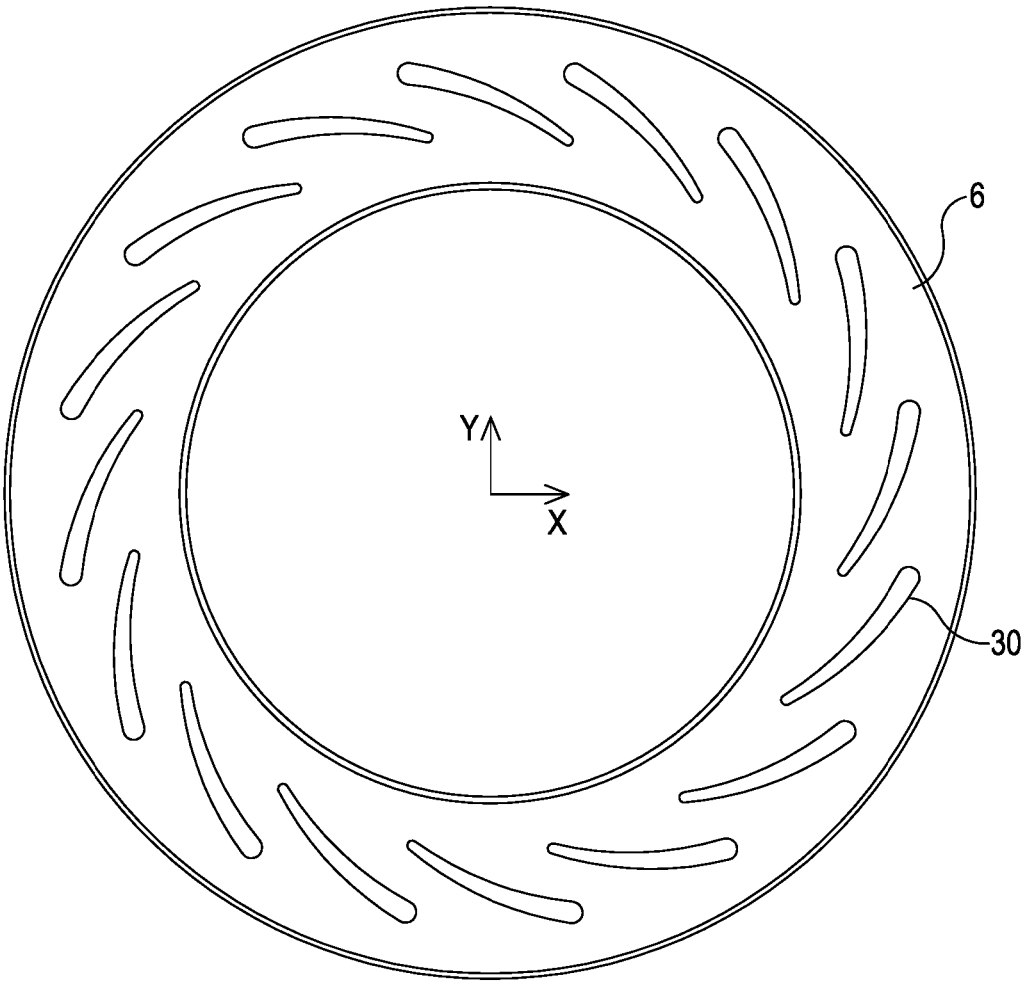
FIG. 3 is an axial view of a shroud which can be used in the known arrangement of FIG. 1.

Facing the nozzle ring 5, is the shroud 6 illustrated in FIG. 3. FIG. 3 is a view looking towards the shroud 6 from the nozzle ring 5 (i.e. towards the right side of FIG. 1). The shroud defines slots 30 (that is, through-holes) for receiving respective ones of the vanes 7. The edge of each slot is an inwardly-facing slot lateral (i.e. transverse to the axis 100) slot surface. Note that in FIG. 3 the slots 30 are not illustrated as having the same profile as the vanes 7 of FIG. 2, but typically the respective profiles do have substantially the same shape although the slots are of greater size than the vanes.

Figure 4:
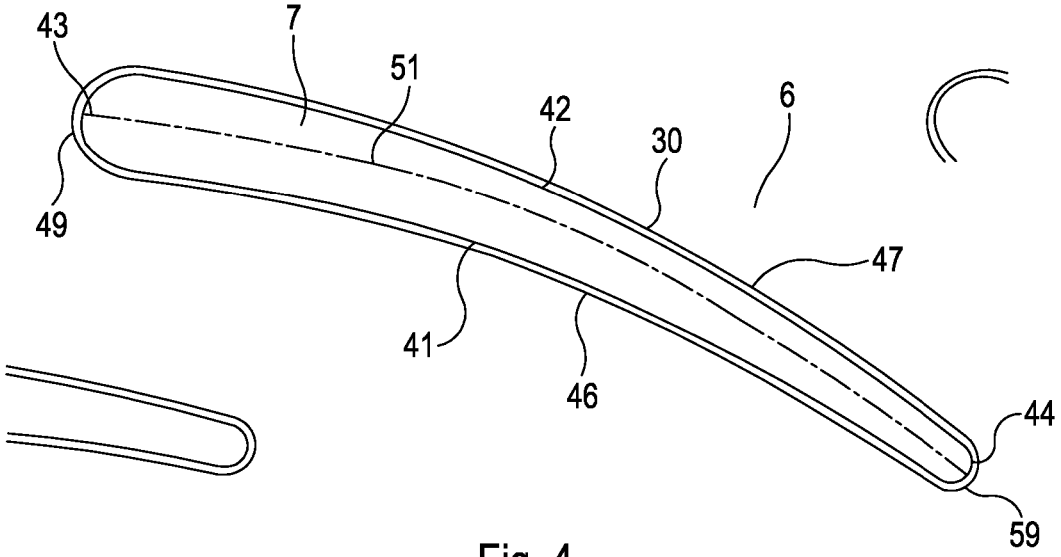
FIG. 4 shows the positional relationship between the nozzle ring of FIG. 2 and the shroud of FIG. 3.

FIG. 4 is another view looking in the axial direction from the nozzle ring 5 towards the shroud 6 (i.e. towards the right side of FIG. 1(*a*)), showing a representative vane 7 inserted into a respective representative slot 30. The vane 7 has a generally arcuate (crescent-shaped) profile, although in other forms the vanes are substantially planar.

Specifically, the vane 7 has a vane inner surface 41 which is closer to the wheel. The vane inner surface 41 is typically generally concave as viewed in the axial direction, but may alternatively be planar. The vane 7 also has a vane outer surface 42 which is closer to the exhaust gas inlet of the turbine. Each of the vane inner and outer surfaces 41, 42 is a major surface of the vane. The vane outer surface 42 is typically convex as viewed in the axial direction, but may also be planar. The major surfaces 41, 42 of the vane 7 face in generally opposite directions, and are connected by two axially-extending end surfaces 43, 44 which, as viewed in the axial direction, each have smaller radii of curvature than either of the surfaces 41, 42. The end surfaces 43, 44 are referred to respectively as the leading edge surface 43 and the trailing edge surface 44.

In most arrangements, the vane outer surface 42 is arranged to oppose the motion of the exhaust gas the inlet passageway, i.e. the motion of the exhaust gas in the inlet passageway is such as to direct the exhaust gas against the vane outer surface. Thus, the vane outer surface 42 is typically at a higher pressure than the vane inner surface 41, and is referred to as the "high pressure" (or simply "pressure") surface, while the vane inner surface 41 is referred to as the "low pressure" (or "suction") surface. These oppose corresponding portions of the inwardly-facing surface which define the edge of the slot 30, and which are given the same respective names.

As viewed in the axial direction, each vane 7 has a median line 51 which extends from one end of the vane to the other (half way between the vane inner and outer surfaces 41, 42 when viewed in the axial direction), and this median line has both a radial and a circumferential component. We refer to the surface of the slot which the vane inner surface 41 faces as the slot inner surface 46, and the surface of the slot which the vane outer surface 42 faces as the slot outer surface 47. As shown in FIG. 4, there is a gap of substantially constant width between the periphery of the vane 7 and the surface of the slot 30. This gap includes four portions: between the vane inner surface 41 and the slot inner surface 46; between the vane outer surface 42 and the slot outer surface 47; and between the vane's leading and trailing edge surfaces 43, 44, and respective leading and trailing portions 49, 59 of the edge of the slot. The surfaces 46, 47, 49 and 59 together constitute the inwardly-facing slot surface which defines the slot.

Figure 5:
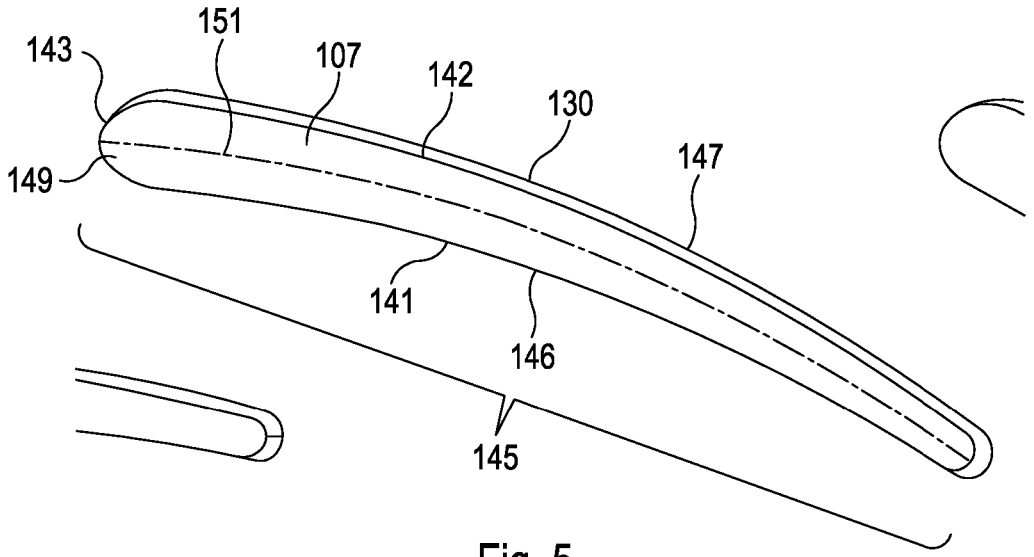
FIG. 5 shows a possible positional relationship between a vane and a respective slot.

FIG. 5 shows a possible positional arrangement between a vane and shroud slot which is proposed in GB 1619347.6. The turbine has the form illustrated in FIGS. 1 and 2, with the difference that the vanes and/or slots in the shroud are differently shaped and sized. In FIG. 5, elements corresponding to elements of FIGS. 1 to 4 are given reference numerals 100 higher. Thus, a representative vane 107 is depicted within a representative slot 130. The vane outer surface 142 faces a slot outer surface 147, and a vane inner surface 141 faces a slot inner surface 146. Optionally, the vane 107 may be longitudinally-symmetric along the whole of its length (i.e. with the same profile, as viewed in the axial direction, in all axial positions). In another possibility, only a part of the vane 107 may be axially symmetric, e.g. including the portion which can be inserted into the slot 130 when the vane 107 is in its most advanced position. In this case, the portion of the vane shown in FIG. 5 is part of this axially symmetric portion of the vane. The vane 107 is integrally formed with the nozzle ring 5, as a one-piece unit, for example by casting and/or machining.

In contrast to the known vanes of FIG. 4, the vane 107 of FIG. 5 has a narrower clearance between the vane inner surface 141 and the opposed slot inner surface 146. By contrast, a much wider gap exists between the vane outer surface 142 and the corresponding portion 147 of the slot outer surface 147. This means that exhaust gas entering the shroud recess 8 between the outer vane surface 142 and the slot outer surface 147 is largely prevented from exiting the shroud recess between the vane inner surface 141 and the slot inner surface 146.

To further this effect, the vane surface and slot surface are formed with a conformal portion 145 which extends along at least about 80% of the length of the median line 151. As illustrated in FIG. 5, the conformal portion 145 of the vane surface in FIG. 5 includes substantially all of the vane inner surface 141. The profile (that is the shape, as viewed in the axial direction) of the vane inner surface 141 and a corresponding portion of the slot inner surface 146 are very similar to each other, so that they can be placed against each other with a very small gap between them along the whole length of the conformal portion 145. Specifically, the profile of the vane inner surface 141 and the corresponding portion of the slot inner surface 146 at room temperature are such that they may be positioned against each other with a gap between them which, e.g. transverse to the median line, is no more than 0.35% of the nozzle radius 71. The vane's leading edge surface 143 is in contact with the corresponding portion 149 of the inner surface of the slot 130.

If there is differential thermal expansion between the vanes 107 and the shroud (for example, because they are formed from different materials and/or experience different temperatures), the conformal portion of the vane 107 may be forced against the against the slot inner surface 146. Fictional force between them may then prevent axial motion of the vane relative to the shroud. However, there is a certain free play in the system (for example, due to the coupling of the nozzle ring 5 to the rods illustrated in FIG. 2, the nozzle ring may have a certain inherent freedom to rotate about the axis 100), which allows the vanes 107 to retract to a certain extent from the conformal surface of the slot.

Figure 6:
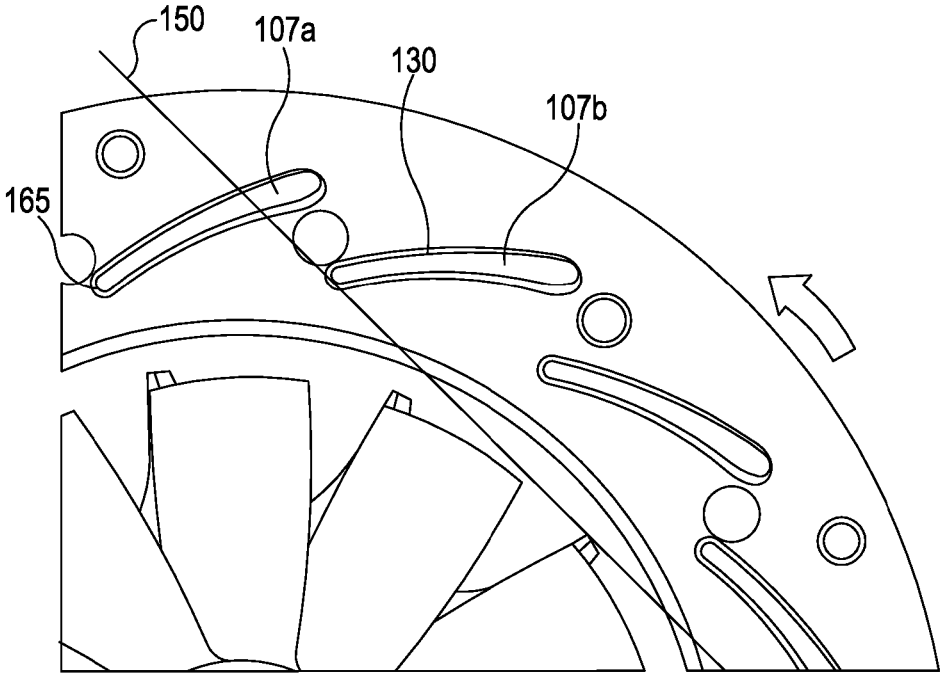
FIG. 6 illustrates the formation of foreign object damage on vanes of a turbine.
Figure 7:
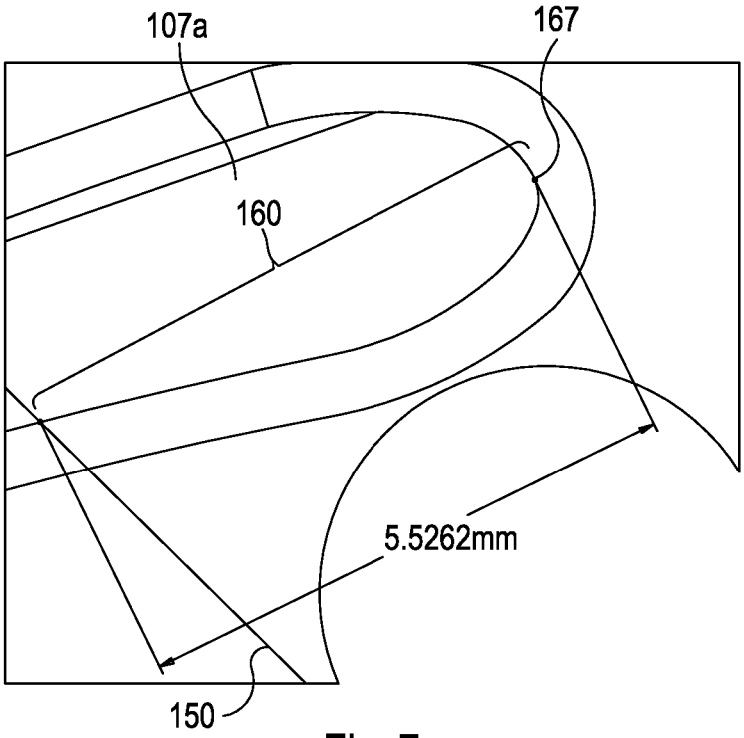
FIG. 7 illustrates a region of the outer surface of the vane which is not subject to foreign object damage.

FIGS. 6 and 7 illustrate the formation of foreign object damage (FOD) during the use of the turbine of FIG. 5. The large arrow indicates the general direction of rotation of the exhaust gas entering the turbine, and rotation of the turbine wheel. FIG. 6 is a view of the shroud in the axial direction, and FIG. 7 is an enlarged portion of FIG. 6. The shroud defines the slots 130 which contain the respective vanes 107. It has been found experimentally that for a given one of the vanes 107 (indicated as 107*a*) a line 150 exists, extending from the trailing edge of the adjacent vane (indicated as 107*b*) in the upstream direction (i.e. in the direction from the vane 107*a* which is opposite to the large arrow in FIG. 6), such that the vane 107*b* protects the vane 107*a* from FOD in a "leading surface portion" 160 of the inner surface of the vane 107*a* which is radially outward of the line 150. The line 150 represents, in fact, the trajectory of a particle of debris which just passes the inner end of the vane 107*b*, and then impacts on the vane 107*a*. All FOD damage to the vane 107*a* is between the interception of the line 150 with the inner surface of the vane 107*a* and the trailing edge 165 of the vane 107*a*.

In the case of a nozzle ring of nozzle radius 48.1 mm, and with each of the vanes having a length of 23 mm (i.e. the length of the median line), the undamaged portion of the vane inner surface 141 has been found to extend for at least the first 4 mm of the length of the median line from the end of the median line at the leading edge 167 (i.e. 17% of the length of the vane). Between 4 mm and 5 mm there are some small impact craters and minor pitting. At all points further than 5 mm from the leading edge 167 of the vane 107*a*, the surface has the same condition. This effect is observed to be equal on all the vanes of the turbine. (Note that a computer simulation suggested at all FOD would be at least 5.5262 mm from the leading end 167, but this was found to be an over-estimate.)

Figure 8:
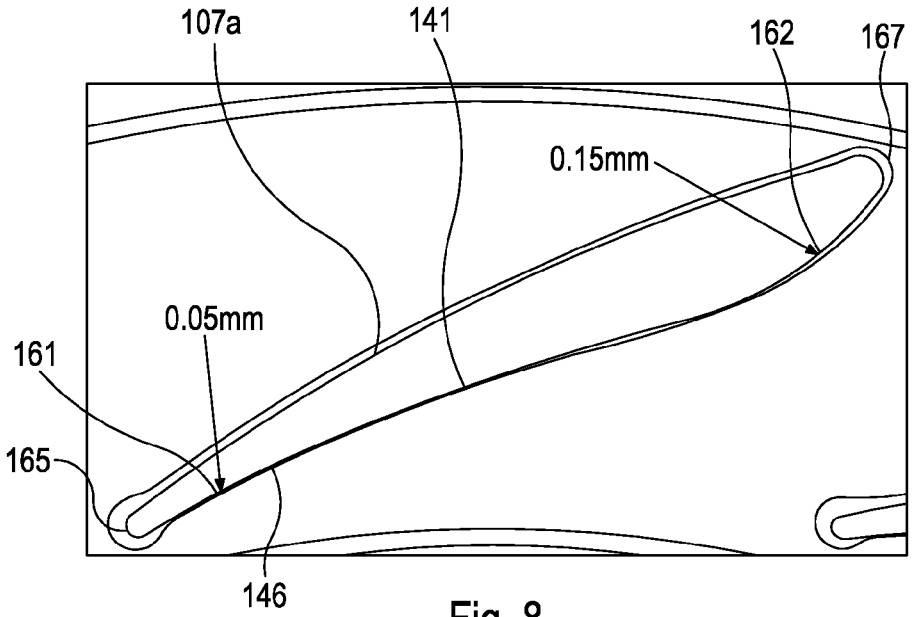
FIG. 8 indicates how the positional arrangement of FIG. 5 is modified due to foreign object damage.

FIG. 8 illustrates a result of the FOD at a trailing part of the vans 107*a*. Suppose that at a point 161 near the trailing edge 165 of the vane 107*a*, there is FOD (such as a raised crater) to the inner surface of the vane 107 which causes the portion of the inner surface 141 of the vane 107*a* near the damage to be spaced from the opposing slot inner surface 146 by a distance of 0.05 mm. It is found that this can result, at a point 162 on the vane inner surface 141 near the leading edge 167, in a larger spacing (such as 0.15 mm) between the vane 107*a* and the slot inner surface 146. Gas is able to pass through this gap (from the recess behind the shroud) to the low pressure side of the vane 107, reducing the efficiency of the turbine.

Figure 9:
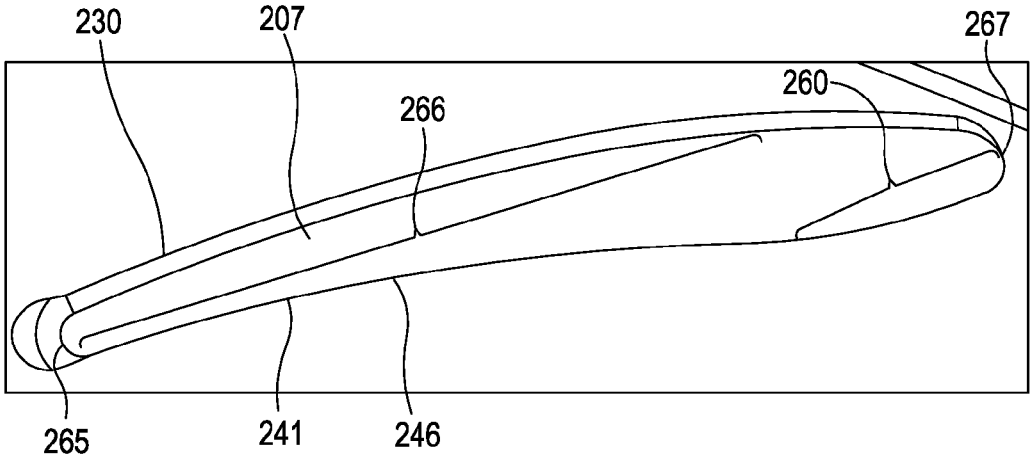
FIG. 9 illustrates the positional relationship of a vane and a respective slot in a first embodiment of the disclosure.

Turning to FIG. 9, a portion of a first embodiment of the disclosure is illustrated. The embodiment includes a representative vane 207 having at least a portion which is longitudinally-symmetric parallel to the axis 100, and a representative slot 230 which is longitudinally-symmetric in the direction 100. The view of FIG. 9 is looking parallel to the direction 100, and shows the longitudinally-symmetric (portion of the) vane 207 in cross-section. The vane 207 has opposed major surfaces (an inner surface and an outer surface) with a median line (not shown) half way between them, extending from a leading edge of the vane 207 to a trailing edge. To either side of the median line is a major surface of the vane where the profile has relatively low curvature, and at either end of the median line the curvature of the profile is higher than on the major surfaces.

The embodiment is a turbine with a construction equal to that of the known system of FIGS. 1-3 (and accordingly elements corresponding to respective elements of the vane and slot of FIGS. 5-8 are given reference numerals 100 higher), with the sole difference that the radially inner surface 241 (vane inner surface) of the vane 207 and/or the slot inner surface 246 of the slot 230 have different respective profiles from the known system of FIGS. 1-3.

Firstly, in a leading surface portion 260 of the vane 207, the vane inner surface 241 and slot inner surface 246 closely conform to each other. In particular, they may be designed with exactly the same shape, but in practice diverge from each other by 1 micron to 50 microns, or more preferably 1 micron to 25 microns.

Secondly, when the vane inner surface 241 and slot inner surface 246 are in contact with each other in the leading portion 260, at all positions on the vane inner surface 241 which are closer towards the trailing edge 265 than the leading portion 260 (this set of positions is referred to as a "trailing surface portion" 266 of the vane inner surface 241), the vane inner surface 241 is spaced from the slot inner surface 246. The spacing in substantially all of the trailing surface portion 266 may be at least 0.05 mm, which, in the case of a nozzle ring with a nozzle radius of 48.1 mm, corresponds to about 0.1% of the nozzle radius. In practice, tolerances in the manufacture of the vane 207 or slot 230 can cause this spacing to be reduced. Furthermore, in use this spacing is reduced at isolated positions within the trailing surface portion 266 due to crater damage on the vane inner surface 241.

However, even if there is FOD in the trailing surface portion 266 which causes the surface of the vane inner surface 241 to be raised by a height of 0.05, this will not cause the vane inner surface 241 to impact the slot inner surface 246 in the trailing surface portion 266, and therefore will not cause the vane inner surface 241 to be spaced from the slot inner surface 246 in the leading surface portion 260.

Similarly, if, due to tolerances in the manufacture of the vane 207 and/or the slot 230, the inner surface 241 of the vane 207 in the trailing surface portion 266 happens to be deformed by a distance 0.05 mm in the direction toward the slot inner surface 246, this will not cause the vane inner surface 241 to impact the slot inner surface 246 in the trailing surface portion of the vane inner surface 241, so it will not cause the inner surface 241 to be spaced from the slot inner surface 246 in the leading surface portion 260. In practice the manufacturing tolerance of the vane 207 and slot 230 may be as high as 0.1 mm, so a spacing of 0.05 mm merely reduces the chance of the vane inner surface 241 being spaced from the slot inner surface 246 in the leading surface portion 260. For that reason, it may be preferred to provide a larger spacing between the vane inner surface 241 and the slot inner surface 246 in at least the majority of the trailing surface portion 266, such as a spacing of 0.1 mm.

The spacing between the vane inner surface 241 and the slot inner surface 246 in the trailing surface portion 266 has the further advantage of reducing the risk of the vane 207 becoming stuck to the shroud due to a thermal transient.

In FIG. 9 the range of contact portions of the vane slot and slot surfaces is shown including all the radially inner surface of the vane up to the leading end 267 of the vane 207, but not including any of the radially outer surface of the vane 207. However, in variants of the embodiment, a radially outer portion of the vane 207 proximate the leading edge of the vane 207 may contact the slot surface (in the manner shown in FIG. 7).

Figure 10A:
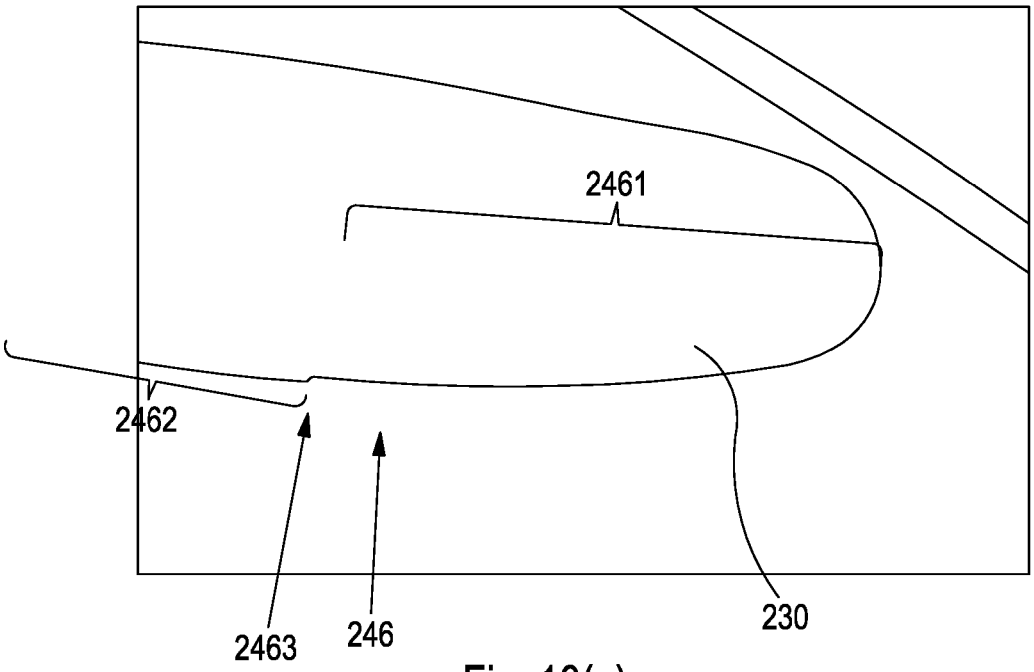
FIG. 10, which is composed of FIGS. 10(*a*) and 10(*b*), illustrates the profile of a slot in the first embodiment of the disclosure.
Figure 10B:
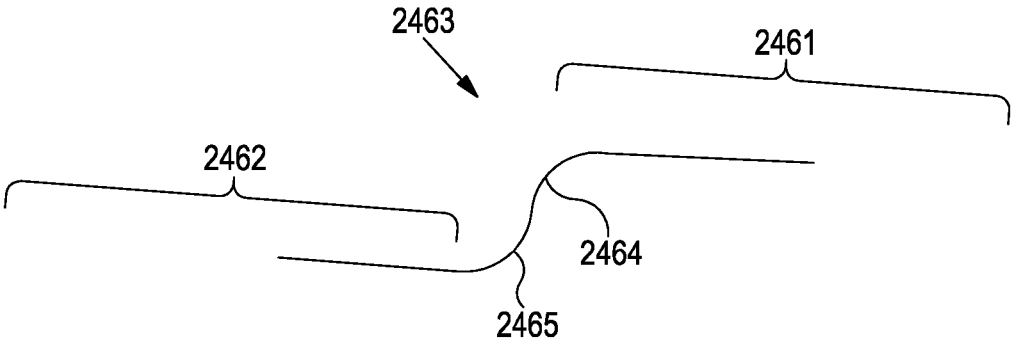

FIG. 10(*a*) shows the profile of the slot 230 with no vane present. The view is parallel to the rotational axis 100, and the slot is longitudinally symmetric in this direction. The slot inner surface 246 includes a leading surface portion 2461, which, when the vane 207 is present, lies along the leading surface portion 260 of the vane inner surface 241. The slot inner surface 246 further includes a trailing surface portion 2462 which, in use, is spaced from a corresponding trailing surface portion of the vane inner surface 241. As illustrated in FIG. 10(*b*), which is an enlarged view of a portion of FIG. 10(*a*), there is a transition region 2463 between the leading and trailing surface portions 2461, 2462 of the slot inner surface 246, including a convex portion 2464 of the surface 246, and a concave portion 2465 of the surface 246. The length along the vane of the portion 2461 may be about 5.33 mm, and the radius of curvature of each of the portions 2464, 2465 may be about 0.5 mm (i.e. a factor of about 10 lower).

Figure 11:
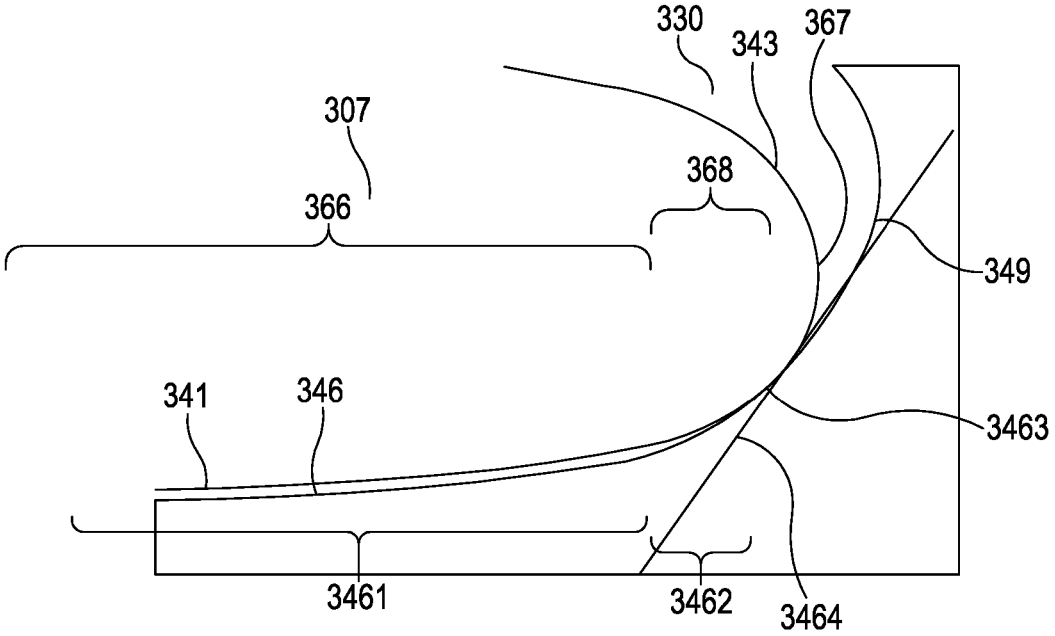
FIG. 11 illustrates the positional relationship of a vane and a respective slot in a second embodiment of the disclosure.

Turning to FIG. 11, a view is shown of a second embodiment of the disclosure. Elements having the same meaning as elements of the first embodiment are given reference numerals 100 higher. The embodiment includes a vane 307 having at least a portion which is longitudinally-symmetric parallel to the axis 100, and a slot 330 which is longitudinally-symmetric in the direction 100. As in the first embodiment, the vane 307 has opposed major surfaces (an inner surface and an outer surface) with a median line half way between them, extending from a leading edge of the vane to a trailing edge. The view of FIG. 11 is looking parallel to the direction 100, and shows the longitudinally-symmetric (portion of the) vane 307 in cross-section. A trailing surface portion 366 of the vane inner surface 341 (again, the low pressure side of the vane) is conformal with a trailing surface portion 3461 of the slot inner surface 346. The two trailing surface portions are slightly spaced apart, e.g. with a substantially-constant spacing between them. The spacing is typically in the range 10 microns to 250 microns, and more preferably at least 25 microns and/or no more than 100 microns. However, the vane inner surface 341 also includes a leading surface portion 368 opposing a leading surface portion 3462 of the slot inner surface 346 which gradually approaches the vane inner surface 341, until the two contact each other at a contact point 3463. The contact point 3463 may be on a line 3464 which is a tangent to the profile of the vane 307 and passes through the rotational axis 100, which is at the centre of the shroud. This position is chosen to minimise (or substantially eliminate) radial force transmitted between the vane and the shroud.

From the point 3463 towards the leading edge 367 of the vane 307, the vane's leading edge surface 343 is spaced from the opposed corresponding portion 349 of the inner surface 346 of the slot 330. The distance of the contact point 3463 from the leading edge 367 of the vane may be less than 10% of the length of the median line, or even less than 5%. The contact between the vane 307 and the inner surface of the slot 330 extends along much less than 5% of the median line of the vane between its opposed major surfaces, such as along less than 1% of the length of the median line, or even 0.1% of the length of the median line.

Since the trailing surface portion 3461 of the slot inner surface 346 is spaced from the trailing surface portion 366 of the vane inner surface 341, imperfections on the trailing surface portions due to machining tolerances and/or due to FOD to the vane 307, do not cause the trailing surface portions to touch each other. Thus, there is no force developed between the trailing surface portions which separates the slot inner surface 346 and the vane inner surface 341 in their respective leading surface portions 368, 3462, such that contact at the contact point 3463 is lost.

Since all the contact between the vane 307 and the slot 330 is at the narrow contact point 3463, there is little of no risk of the vane 307 becoming locked against the slot 330, such that sliding motion of the vane 307 in the axial direction is impaired.

What is claimed is:

1. A turbine comprising:

(i) a turbine wheel having an axis, (ii) a turbine housing for defining a chamber for receiving the turbine wheel for rotation of the turbine wheel about an axis, the turbine housing further defining a gas inlet, and an annular inlet passage from the gas inlet to the chamber, (iii) a ring-shaped shroud defining a plurality of slots and encircling the axis, each slot having a slot surface; and (iv) a nozzle ring supporting a plurality of vanes which extend from the nozzle ring parallel to the axis, and project through respective ones of the slots;

each of the vanes having:

an axially-extending vane surface which includes (i) a vane outer surface facing a radially-outer surface of the corresponding slot, (ii) an opposed vane inner surface facing a radially-inner surface of the corresponding slot, and a median line between the vane inner surface and the vane outer surface extending from a leading end of the vane to a trailing end of the vane;

the vane being positioned with a leading surface portion of the vane inner surface contacting a corresponding leading surface portion of the respective slot surface;

the vane inner surface further including a trailing surface portion extending along at least 33% of the median line and, which, at room temperature and when the leading surface portions are in contact, is spaced from an opposed trailing surface portion of the slot surface by a distance in the range 10 microns to 250 microns.

2. A turbine according to claim 1 in which, at room temperature and when the leading surface portions are in contact, the trailing surface portions are spaced apart by a distance in the range 25 microns to 100 microns.

3. A turbine according to claim 1 in which the trailing portion of the vane surface extends for at least 50% of the length of the median line.

4. A turbine according to claim 1 in which the leading surface portion of the vane extends along at least 15% of the length of the median line, the respective profiles of the leading surface portion of the vane surface and a corresponding leading surface portion of the respective slot surface diverging from each other by no more than 1 micron to 50 microns.

5. A turbine according to claim 4 in which the leading edge portion includes a point where the median line intercepts the leading edge of the vane.

6. A turbine according to claim 1 in which the leading surface portion of the vane extends along less than 5% of the length of the median line.

7. A turbine according to claim 1 in which, in use, radially inner portions of the surfaces of the vane and slot are at a lower pressure than radially outer portions of the surfaces of the vane and slot.

8. A turbocharger comprising a turbine comprising:

(i) a turbine wheel having an axis;

(ii) a turbine housing for defining a chamber for receiving the turbine wheel for rotation of the turbine wheel about an axis, the turbine housing further defining a gas inlet, and an annular inlet passage from the gas inlet to the chamber;

(iii) a ring-shaped shroud defining a plurality of slots and encircling the axis, each slot having a slot surface; and (iv) a nozzle ring supporting a plurality of vanes which extend from the nozzle ring parallel to the axis, and project through respective ones of the slots;

each of the vanes having:

an axially-extending vane surface which includes (i) a vane outer surface facing a radially-outer surface of the corresponding slot, (ii) an opposed vane inner surface facing a radially-inner surface of the corresponding slot; and a median line between the vane inner surface and the vane outer surface extending from a leading end of the vane to a trailing end of the vane;

the vane being positioned with a leading surface portion of the vane inner surface contacting a corresponding leading surface portion of the respective slot surface;

the vane inner surface further including a trailing surface portion extending along at least 33% of the median line and, which, at room temperature and when the leading surface portions are in contact, is spaced from an opposed trailing surface portion of the slot surface by a distance in the range 10 microns to 250 microns.

9. In combination, a ring-shaped shroud and a nozzle ring, the shroud and nozzle ring being for positioning within a turbine including a turbine wheel, and a turbine housing defining a chamber for receiving the turbine wheel for rotation of the turbine wheel, the turbine housing further defining a gas inlet, and an annular inlet passage from the gas inlet to the chamber;

the ring-shaped shroud defining a plurality of slots and encircling an axis which in use is the rotational axis of the turbine wheel within the chamber, each slot having a slot surface; and a nozzle ring supporting a plurality of vanes which extend from the nozzle ring parallel to the axis, and project through respective ones of the slots;

each of the vanes having:

an axially-extending vane surface which includes (i) a vane outer surface facing a radially-outer surface of the corresponding slot, (ii) an opposed vane inner surface facing a radially-inner surface of the corresponding slot, and a median line between the vane inner surface and the vane outer surface extending from a leading end of the vane to a trailing end of the vane;

the vane being positioned with a leading surface portion of the vane inner surface contacting a corresponding leading surface portion of the respective slot surface;

the vane inner surface further including a trailing surface portion extending along at least 33% of the median line and, which, at room temperature and when the leading surface portions are in contact, is spaced from an opposed trailing surface portion of the slot surface by a distance in the range 10 microns to 250 microns.

* * * * *